US006311601B1

(12) United States Patent
Love

(10) Patent No.: US 6,311,601 B1
(45) Date of Patent: Nov. 6, 2001

(54) METHOD OF MANUFACTURING DIES USED IN CUTTING AND CREASING PAPERBOARD

(76) Inventor: Marc C. Love, 2000 Middlebury St., Elkhart, IN (US) 46516

( * ) Notice: Subject to any disclaimer, the term of this patent is extended or adjusted under 35 U.S.C. 154(b) by 0 days.

(21) Appl. No.: 09/314,993

(22) Filed: May 20, 1999

Related U.S. Application Data

(60) Provisional application No. 60/119,001, filed on Feb. 8, 1999.

(51) Int. Cl.[7] ..... B26D 11/00

(52) U.S. Cl. ..... 83/863; 83/886; 83/884; 83/885

(58) Field of Search ..... 83/863, 862, 884, 83/886, 673, 663, 885; 76/107.8

(56) References Cited

U.S. PATENT DOCUMENTS

| | | | | |
|---|---|---|---|---|
| Re. 28,143 | * | 9/1974 | Sarka | 83/862 |
| 2,552,353 | * | 5/1951 | Troth et al. | 83/862 |
| 3,142,233 | * | 7/1964 | Downie | 76/107.8 |
| 3,786,732 | * | 1/1974 | Forbes, Jr. | 83/862 |
| 4,248,117 | * | 2/1981 | Bugnone | 83/863 |
| 4,608,895 | * | 9/1986 | Bell et al. | 83/663 |
| 4,831,930 | * | 5/1989 | Leanna | 101/389.1 |
| 4,934,231 | * | 6/1990 | Chesnut et al. | 83/663 |
| 5,761,982 | * | 6/1998 | Abt et al. | 83/863 |
| 5,916,335 | * | 6/1999 | Gerhardt | 83/663 |

* cited by examiner

*Primary Examiner*—M. Rachuba
(74) *Attorney, Agent, or Firm*—Baker & Daniels

(57) ABSTRACT

A die for working sheet material by cutting the sheet material along cutting lines and scoring the sheet material along scoring lines offset from the cutting lines includes a pair of opposed, coacting die plates. One of the die plates carries knife edges extending along the cutting lines, and the other die plate includes a raised cutting land extending longitudinally along the desired cutting lines and extending transversely along the cutting lines, such that the knife edge engages the land as the sheet material is fed between the plates to thereby sever the sheet material along the cutting lines. The die plate carrying the cutting land also includes one or more pairs of offset scoring lands defining a scoring channel therebetween defining the scoring line. The die plate carrying the knife edge includes a scoring land which forces the sheet material into the channel as the sheet metal is fed between the plates to thereby effect scoring of the material.

15 Claims, 6 Drawing Sheets

METHOD OF MANUFACTURING DIES USED IN CUTTING AND CREASING PAPERBOARD

This application claims priority from provisional application No. 60/119,001 filed on Feb. 8, 1999.

BACKGROUND OF THE INVENTION

1. Field of the Invention

This invention relates to a die for cutting and scoring sheet material, such as paper or cardboard.

2. Description of Related Art

A wide range of consumer products are marketed in boxes which are produced in high volumes. These boxes are made from paperboard or cardboard which must be cut to the proper shape and then scored to form fold lines so that the box may be later assembled for use. Labels are made in a similar manner. In general, it is preferable to effect both cutting and scoring in the same procedure using the same set of dies, and it is also preferable that the cutting and scoring dies be either an integral part of, or mounted upon, high speed rollers for high speed production. Sheet material may be cut along predetermined cutting lines by rotary pressure cutting, in which two lands mounted closely adjacent one another along the desired cutting line crush the sheet material between them, thus severing the sheet material. U.S. Pat. No. 3,142,233 discloses such a rotary pressure cutting die. Also commonly used are crush cutting dies, in which a knife edge acts against an anvil, as shown in U.S. Pat. No. 3,965,786, in which paper stock is cut with a knife edge and a plate wrapped around a cylinder. However, the apparatus disclosed in D'Luhy does not permit both cutting and scoring with the same set of dies.

BRIEF SUMMARY OF THE INVENTION

The present invention relates to dies for cutting and scoring sheet material, such as paper, paperboard, or cardboard, which employ crush cutting, but which also permits both cutting and scoring using the same set of die plates. According to the invention, a knife edge which extends along the desired cutting line engages a land on the opposite die plate which also extends along the cutting line and extends transversely across the cutting line. The land is raised above the bed of the die for a distance greater than the thickness of the material being processed. A pair of scoring lands extend parallel on opposite sides of a scoring line which is offset from the cutting line. The scoring lands extend above the bed of a die for substantially the same distance as the cutting land. A third scoring land is mounted on the opposite die plate and is adapted to move within the gap between the pair of scoring lands to thereby engage the sheet material and force it down into the gap, thereby effecting scoring. Accordingly, crush cutting and scoring are effected by the same set of die plates. Furthermore, the die plates are sufficiently thin and are made out of a magnetic material, such as steel, so that the die plates may be mounted on rotating cylinders and secured thereto by magnetic attraction. According to another advantage of the present invention, the lands and cutting knife edges are formed on the die plates by a process which includes chemically etching the die plate and then using rotary cutting tools to finish the knife edges and the lands.

These and other advantages of the present invention will become apparent from the following description, with reference to the accompanying drawings, in which:

DESCRIPTION OF THE PREFERRED EMBODIMENT

The preferred embodiment illustrated is not intended to be exhaustive or to limit the invention to the precise form disclosed. It is chosen and described in order to best explain the principles of the invention and its application and practical use to thereby enable others skilled in the art to best utilize the invention.

Figure 1:
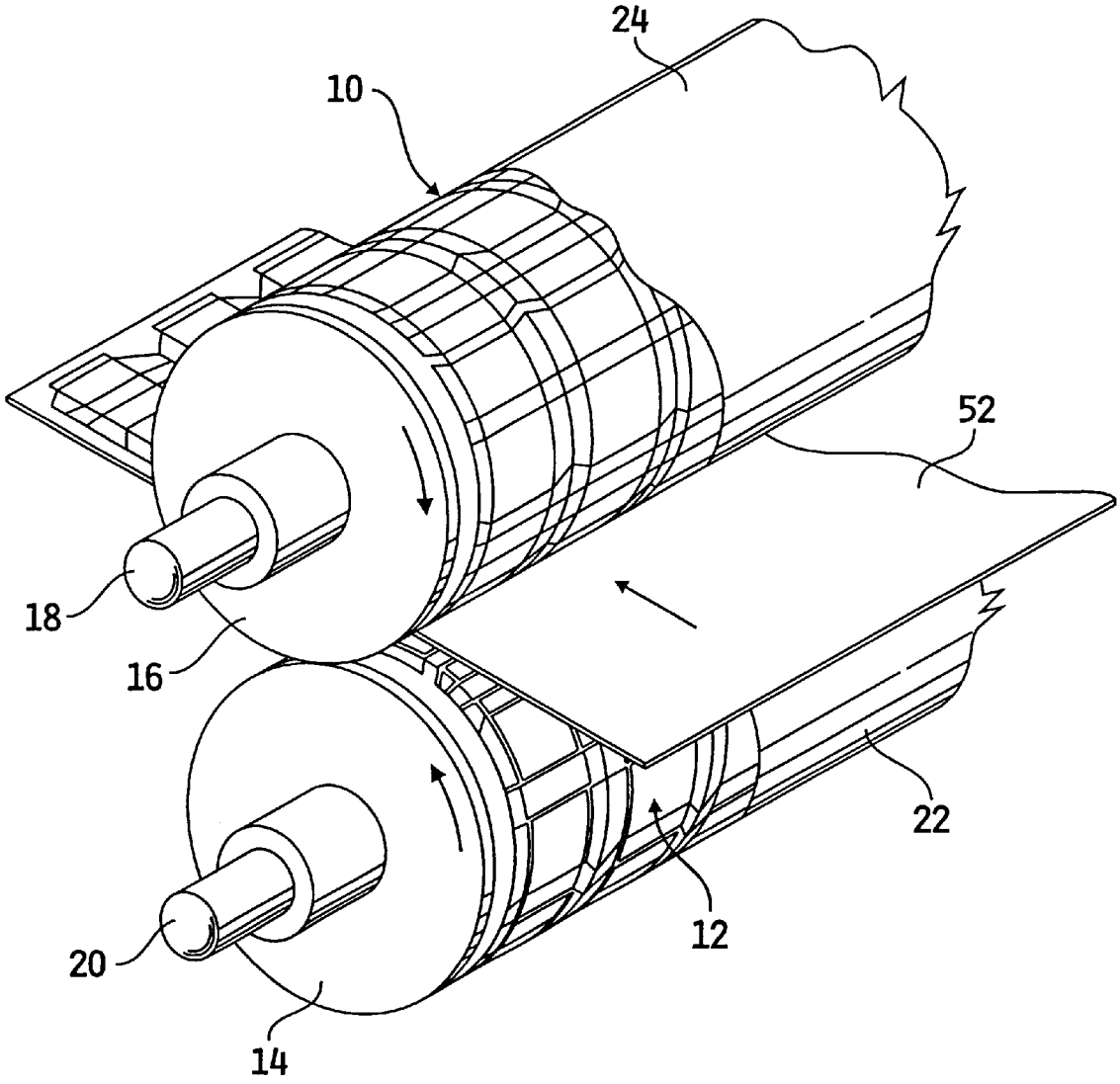
FIG. 1 is a fragmentary perspective view of a pair of two cutting and scoring die plates made according to the present invention mounted on a cutting module.
Figure 2:
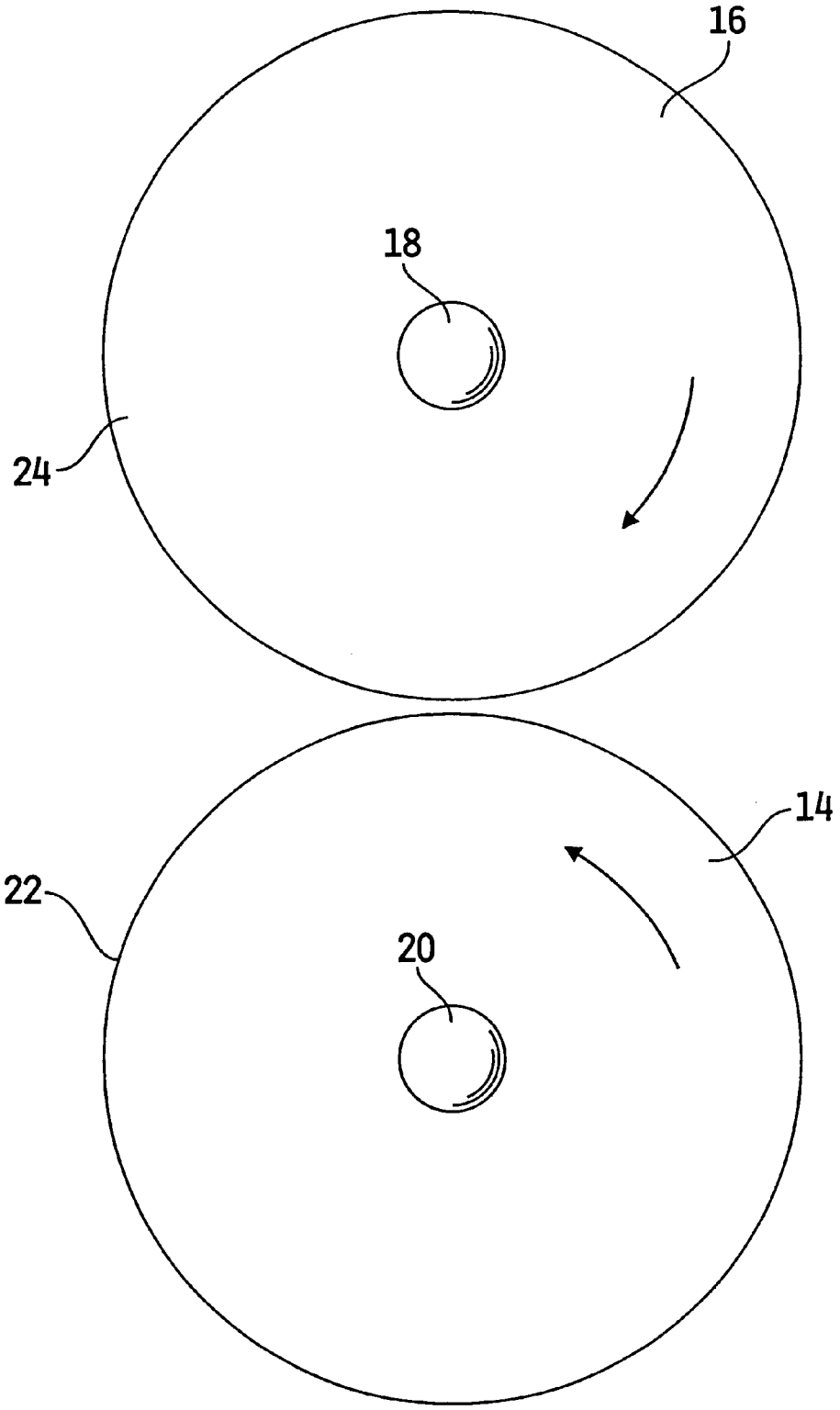
FIG. 2 is a end view of two cylinders of a cutting module without the die plates attached.

The invention includes a male die plate 10 and a female die plate 12 formed of a flexible magnetically attractable material, such as steel. The die plates 10, 12 are mounted upon rotary cylinders 14, 16 of a cutting module as shown in FIG. 1. Cylinders 14, 16 are carried upon axles 18, 20 journaled within suitable bearing blocks in the cutting module. Cylinders 14, 16 are magnetized and have outer faces 22, 24.

Figure 3:
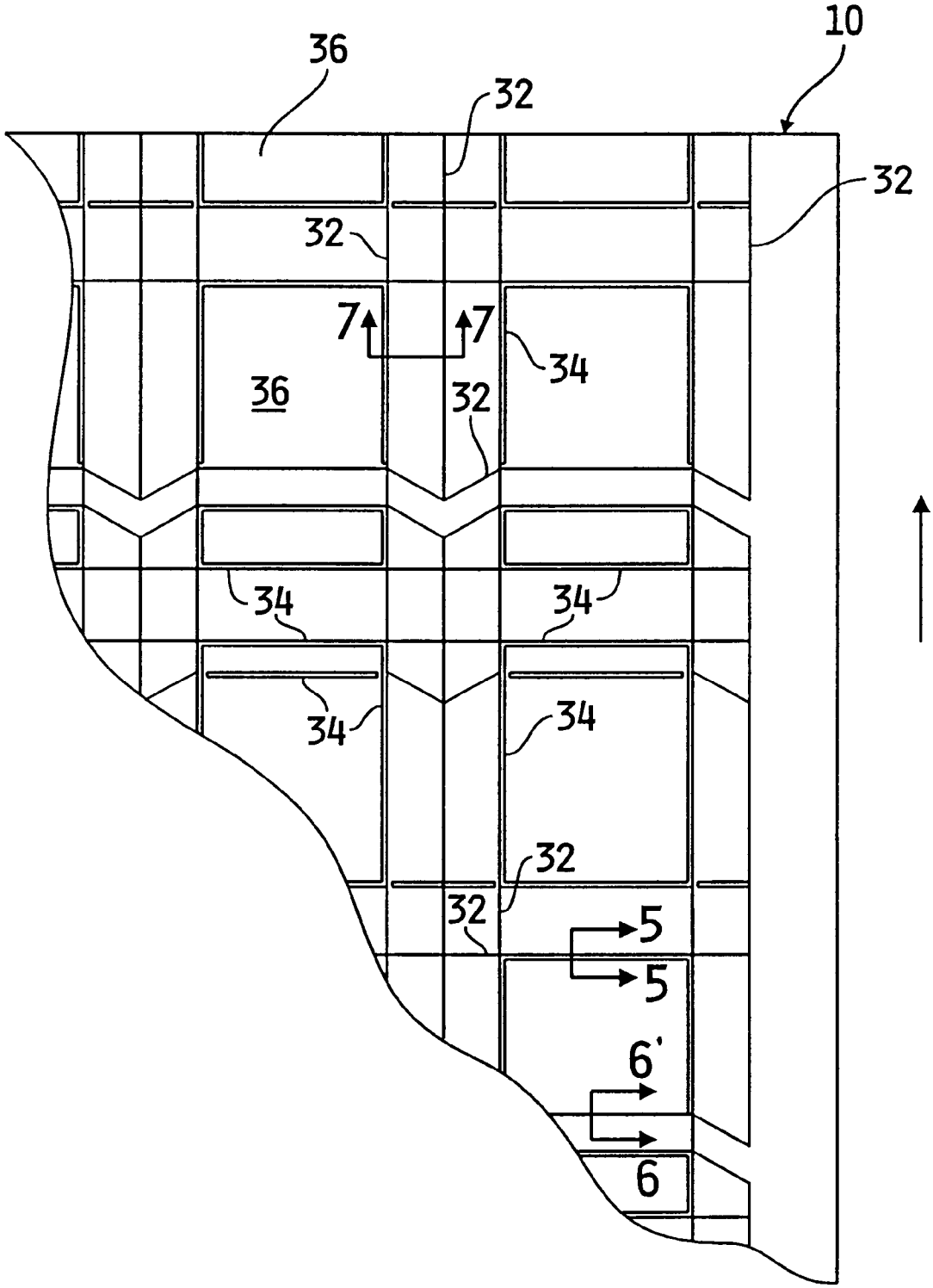
FIG. 3 is a fragmentary plan view of a male die plate.
Figure 4:
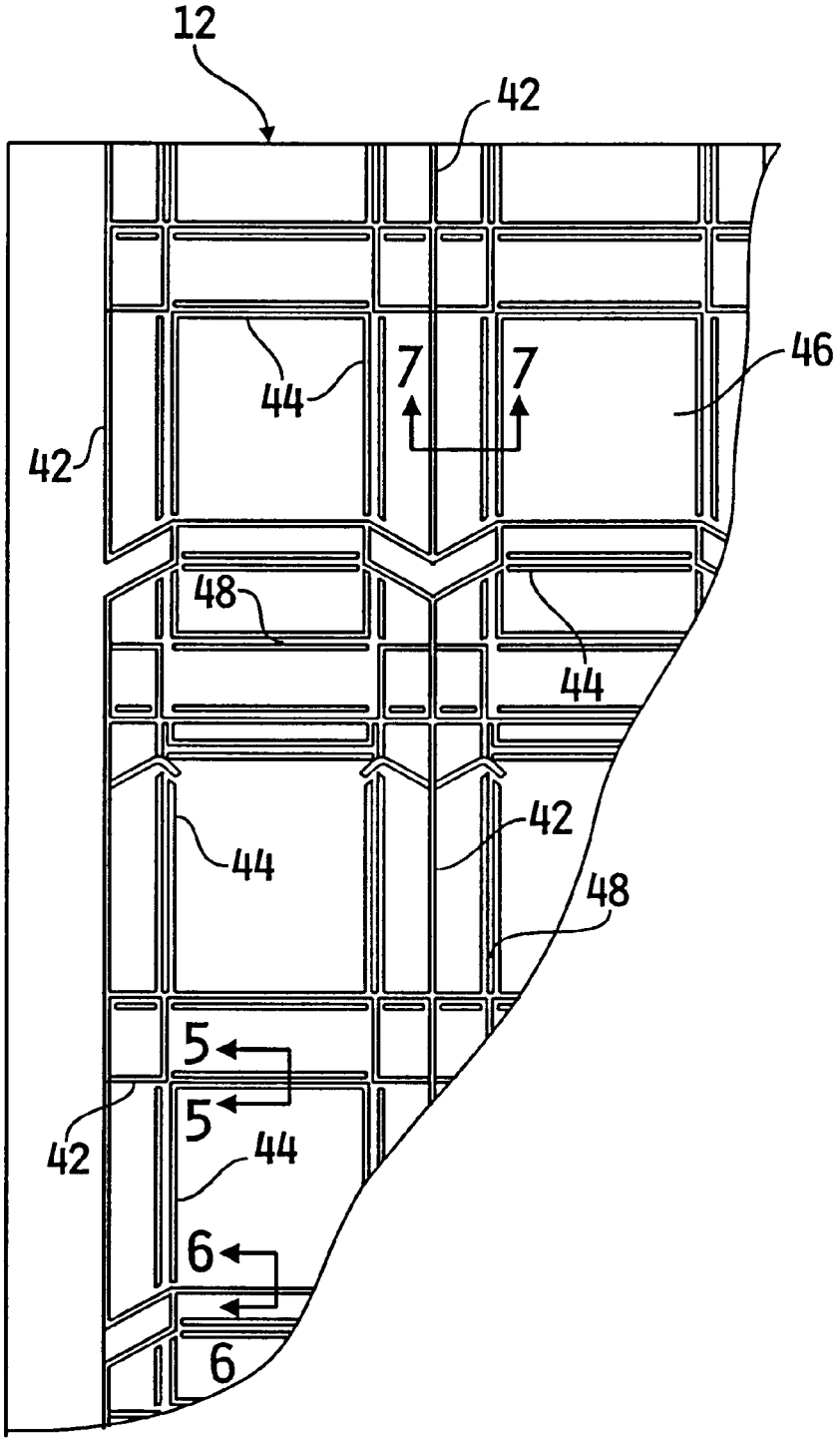
FIG. 4 is a fragmentary plan view of a female die plate.
Figure 5:
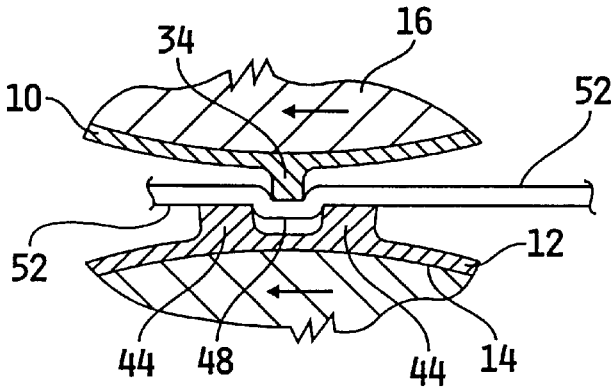
FIG. 5 is a fragmentary cross-sectional view as seen along lines 5—5 of FIGS. 3 and 4 with the die plates mounted on cylinders and with a web therebetween.
Figure 6:
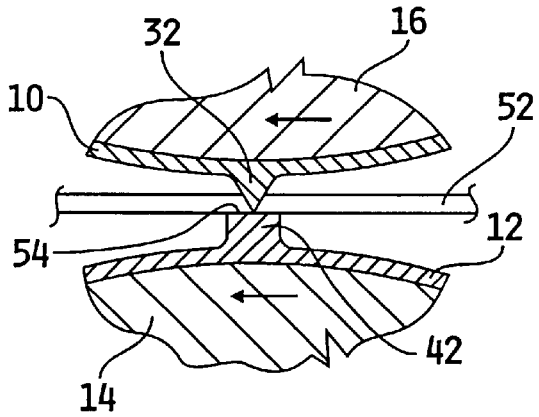
FIG. 6 is a fragmentary cross-sectional view as seen along lines 6—6 of FIGS. 3 and 4 with the die plates mounted on cylinders and with a web therebetween.
Figure 7:
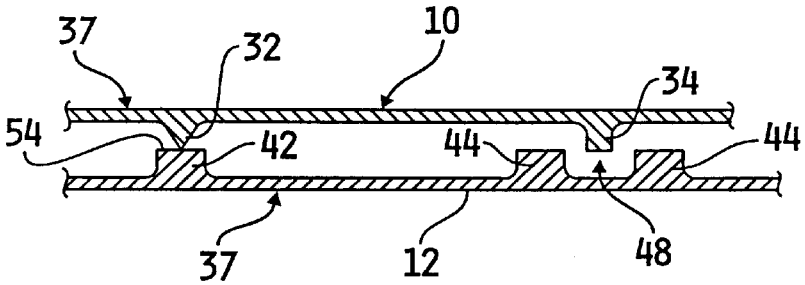
FIG. 7 is a fragmentary cross-sectional view as seen along lines 7—7 of FIGS. 3 and 4, showing relationship of male and female die plates in a planar orientation.

Male die plate 10, as seen in FIG. 3, carries both knife edges 32 and scoring lands 34 extending from the die bed 36. In the illustration, single lines denote knife edges 32 and double lines denote scoring, lands 34. Female die plate 12, as seen in FIG. 4, carries lands which extend from the front die bed 46 and which define a cutting land 42, which extends along a cutting line at which cutting takes place, and channels 48. Cutting lands 42 are formed of a single land and are designed with a cutting surface 54 as seen in FIGS. 6 and 7 for edges 32 of die 10. The cutting lands 42 extend longitudinally along the cutting lines and transversely across the cutting line. Channels 48 are formed between two parallel scoring lands 44 as seen in FIGS. 5 and 7, which extend longitudinally parallel to the desired scoring lines defined by the channels 48. Channels 48 are designed to receive a scoring land 34 of die 10.

To utilize the invention, die plates 10, 12 are magnetically attached to respective cylinders 16, 14. The magnetism of the cylinders provides substantially 100% contact between cylinder faces 22 and 24 and the back faces 37 of dies 10, 12. The cutting module supporting cylinders 14, 16 includes suitable gearing for adjusting the spacing between dies. As cylinders 14, 16 rotate upon the actuation of the cutting module, sheet material 52 is fed between die plates 10, 12. FIGS. 5 and 6 illustrate the interaction between edges 32 and cutting lands 42, and scoring lands 34 and channels 48. As illustrated in FIG. 5, scoring land 34 forces sheet material 52 into channel 48 thereby creating a crease in the material. When edges 32 rotate into alignment with cutting lands 42 as seen in FIG. 6, the knife edge penetrates material 52 completely, thereby creating a cut or perforation in the material. FIG. 7 illustrates the relationship of edges 32, cutting lands 42, scoring lands 34 and channels 48 without material 52 therebetween.

Figure 8:
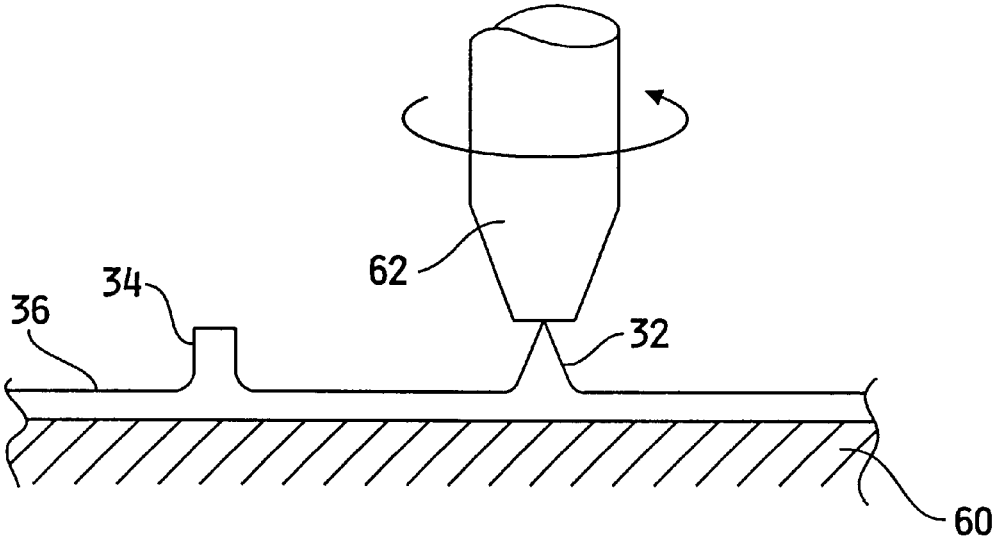
FIGS. 8 and 9 are diagramatic illustrations of the manner in which the die plates of the present invention are finished.

The die plates are manufactured by a chem milling process. An appropriate steel of a suitable thickness, such as low carbon steel hardened to 45–52 $R_c$ may be used, but other steels such as stainless steels can also be used. The steel is cleaned and either laminated with a photo resist or dip coated with a liquid photo resist. The photo resist must be of a type that will allow it to remain bonded to the steel during the etching process. In a process well known to the skilled in the art, a photo mask with the pattern of the layout of the die is applied to the photo resist, the mask is developed, and the photo resist is removed from all portions of the steel except that immediately over the lands and knife edges. The steel is then etched using a suitable etchant of ferric chloride ($FeCl_3$) with a 39–42° Baume, a temperature of 125° F. and a free acid of 0.5–1.6% HCl. It has been determined that etching using the ferric chloride in a spray pattern is the most efficient method to control steel removal. Accordingly, the HCl is sprayed through spray nozzles at a suitable pressure. The die plates are etched until the thickness of the bed allows enough flexibility for the steel plate to be wrapped around cylinders having permanent magnetic forces to hold the steel die in position, as discussed above. After etching is complete, the remaining photo resist is removed. The die plate is then mounted on a table 60 of an appropriate machine equipped with a high speed spindle indicated by the numeral 62. The height of the high speed cutter 62 is set to finish the tops of the lands 34 and knife edges 32 to be formed during finishing at the appropriate height. Angles 64 on the side of the cutter are chosen to finish the sides of the knife edge 32 to an appropriate sharpness. The cutter is then moved over the lands 34 and knife edge 32 to finish them at the appropriate height, as indicated in FIG. 8.

Figure 9:
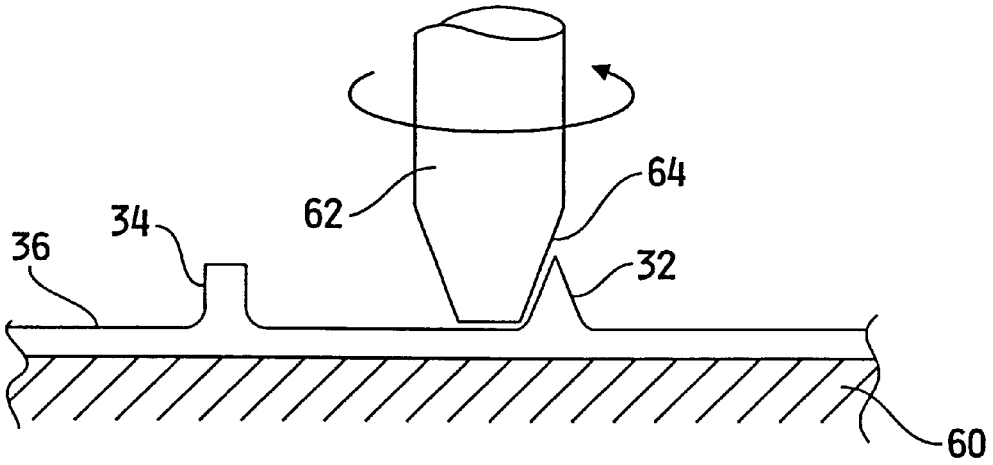

The cutter is then used as illustrated in FIG. 9 to finish the side faces of the knife edge 32 to their appropriate finished angles. The speed of the cutter 62 is in excess of 5,000 RPM.

What is claimed is:

1. Die for working sheet material by cutting said sheet material along a cutting line and scoring said sheet material along a scoring line offset from the cutting line comprising a pair of opposed, coacting die plates, one of said die plates having a knife edge, formed integrally with said die plate and extending along said cutting line, the other die plate having a raised cutting land extending longitudinally along said cutting line and transversely across said cuttting line, said knife edge and said cutting land being directly opposed one another and cooperating to cut said sheet material along said cutting line, said other die plate further including first and second scoring lands displaced from said cutting land, each of said first and second scoring lands extending longitudinally and being displaced transversely from another to form a channel therebetween defining said scoring line, and a third scoring land on said one die plate extending along said scoring line and between said first and second scoring lands to engage said sheet material and force the sheet material into said channel to thereby effect scoring along said scoring line, each of said die plates having a bed, said lands and said knife edge extending directly from a corresponding one of said beds.

2. Die as claimed in claim 1, wherein the distance that said cutting land extends above the bed of the one die plate is equal to the distance that the first and second scoring lands extend above the bed of the one die plate.

3. Die as claimed in claim 1, wherein each of said die plates are mounted on a pair of coacting, offset, rotating cylinders, said cylinders being rotated to cause said die plates to process said sheet material as said sheet material is drawn between said cylinders.

4. Die as claimed in claim 3, wherein the thickness of said die plates is sufficiently thin to permit the die plates to be wrapped around their corresponding cylinders.

5. Die as claimed in claim 4, wherein said cylinders are magnetized and said die plates consist of a magnetically attractable material, said die plates being magnetically secured to their corresponding cylinder.

6. Die as claimed in claim 4, wherein said cylinders are driven at a predetermined speed.

7. Die as claimed in claim 1, wherein said knife edge tapers upwardly from the bed of the one die plate.

8. Die for working sheet material by cutting, said sheet material along a cutting line and scoring said sheet material along a scoring line offset from the cutting line comprising a pair of opposed, coacting die plates, one and only one of said die plates having a knife edge extending along said cutting line at any location on the cutting line, the other die plate having a raised cutting land extending longitudinally along said cutting line and transversely across said cutting line, said knife edge and said cutting land being directly opposed one another and cooperating to cut said sheet material along said cutting line, said die plates further including scoring means offset from said knife edge and cutting land to score said sheet material along said scoring line as the sheet material is cut along the cutting line.

9. Die as claimed in claim 8, wherein said scoring means includes first and second scoring lands, each of said first and second scoring lands extending longitudinally parallel to said scoring line and being displaced transversely from one another to form a channel therebetween defining said scoring line, and a third scoring land on said one die plate extending along said scoring line and between said first and second scoring lands to engage said sheet material and force the sheet material between said first and second scoring lands to thereby effect scoring along said scoring line as said knife edge and cutting land effect cutting of the sheet material along the cutting line.

10. Die as claimed in claim 9, wherein each of said die plates are mounted on a pair of coacting, offset, rotating cylinders, said cylinders being rotated to cause said die plates to process said sheet material as said sheet material is drawn between said cylinders.

11. Die as claimed in claim 10, wherein the thickness of said die plates is sufficiently thin to permit the die plates to be wrapped around their corresponding cylinders.

12. Die as claimed in claim 11, wherein said cylinders are magnetized and said die plates consist of a magnetically attractable material, said die plates being magnetically secured to their corresponding cylinder.

13. Die as claimed in claim 8, wherein each of said die plates are mounted on a pair of coacting, offset, rotating cylinders, said cylinders being rotated to cause said die plates to process said sheet material as said sheet material is drawn between said cylinders.

14. Die as claimed in claim 13, wherein the thickness of said die plates is sufficiently thin to permit the die plates to be wrapped around their corresponding cylinders.

15. Die as claimed in claim 14, wherein said cylinders are magnetized and said die plates consist of a magnetically attractable material, said die plates being magnetically secured to their corresponding cylinder.

* * * * *

UNITED STATES PATENT AND TRADEMARK OFFICE

CERTIFICATE OF CORRECTION

PATENT NO. : 6,311,601 B1
DATED : November 6, 2001
INVENTOR(S) : Marc C. Love

It is certified that error appears in the above-identified patent and that said Letters Patent is hereby corrected as shown below:

Claim 1,
Line 51, insert -- one -- after "and being displaced transversely from"

Claim 8,
Line 15, delete comma after "cutting"

Signed and Sealed this

Twenty-sixth Day of March, 2002

*Attest:*

*Attesting Officer*

JAMES E. ROGAN
*Director of the United States Patent and Trademark Office*